US006918995B2

(12) United States Patent
Frölich et al.

(10) Patent No.: US 6,918,995 B2
(45) Date of Patent: Jul. 19, 2005

(54) PROCESS FOR THE PRODUCTION OF PAPER

(75) Inventors: Sten Frölich, Askim (SE); Fredrik Solhage, Kode (SE); Erik Lindgren, Bohus (SE); Hans E. Johansson-Vestin, Kungälv (SE)

(73) Assignee: Akzo Nobel N.V., Arnhem (NL)

( * ) Notice: Subject to any disclaimer, the term of this patent is extended or adjusted under 35 U.S.C. 154(b) by 25 days.

(21) Appl. No.: 09/923,096

(22) Filed: Aug. 6, 2001

(65) Prior Publication Data

US 2002/0096289 A1 Jul. 25, 2002

Related U.S. Application Data

(60) Provisional application No. 60/249,365, filed on Nov. 16, 2000, provisional application No. 60/223,369, filed on Aug. 7, 2000, provisional application No. 60/223,368, filed on Aug. 7, 2000, and provisional application No. 60/223,367, filed on Aug. 7, 2000.

(30) Foreign Application Priority Data

| | | |
|---|---|---|
| Aug. 7, 2000 | (EP) | 00850135 |
| Aug. 7, 2000 | (EP) | 00850136 |
| Aug. 7, 2000 | (EP) | 00850137 |
| Nov. 16, 2000 | (EP) | 00850195 |

(51) Int. Cl.[7] ..... D21H 17/29; D21H 17/54
(52) U.S. Cl. ..... 162/164.5; 162/175
(58) Field of Search ..... 162/183, 175, 162/164.1, 164.5, 165

(56) References Cited

U.S. PATENT DOCUMENTS

| | | | | |
|---|---|---|---|---|
| 3,562,103 | A | 2/1971 | Moser et al. | 162/175 |
| 4,070,236 | A | 1/1978 | Carrard et al. | 162/164 R |
| 4,750,974 | A | 6/1988 | Johnson | 162/164.1 |
| 4,795,531 | A | 1/1989 | Sofia et al. | 162/164.6 |
| 4,840,705 | A | 6/1989 | Ikeda et al. | 162/175 |
| 5,098,520 | A | 3/1992 | Begala | 162/168.1 |
| 5,129,989 | A | 7/1992 | Gosset et al. | 162/147 |
| 5,185,062 | A | 2/1993 | Begala | 162/168.1 |
| 5,466,338 | A | 11/1995 | Pearson | 162/168.2 |
| 5,514,249 | A | 5/1996 | Cauley et al. | 162/164.1 |
| 5,538,596 | A | 7/1996 | Satterfield et al. | 162/164.5 |
| 5,587,415 | A | 12/1996 | Takeda | 524/458 |
| 5,595,629 | A | 1/1997 | Begala | 162/158 |
| 5,708,071 | A | 1/1998 | Takeda | 524/458 |
| 5,755,930 | A | 5/1998 | Satterfield et al. | 162/164.1 |
| 5,837,100 | A | 11/1998 | Gerli et al. | 162/168.2 |
| 6,001,166 | A | 12/1999 | Ettl et al. | 106/287.2 |
| 6,022,449 | A | 2/2000 | Jansen et al. | 162/135 |

FOREIGN PATENT DOCUMENTS

| | | | |
|---|---|---|---|
| EP | 752 496 | 1/1997 | D21H/23/04 |
| EP | 805 234 | 11/1997 | D21H/23/14 |
| EP | 877 120 | 11/1998 | D21H/17/45 |
| GB | 1177512 | 1/1970 | D21D/3/00 |
| WO | WO 95/21295 | 8/1995 | D21H/17/48 |
| WO | WO 95/21296 | 8/1995 | D21H/17/53 |
| WO | WO 96/17127 | 6/1996 | D21H/17/74 |
| WO | WO 98/33979 | 8/1998 | D21H/17/71 |
| WO | WO 98/33980 | 8/1998 | D21H/17/71 |
| WO | WO 98/33982 | 8/1998 | D21H/17/72 |
| WO | WO 99/55962 | 11/1999 | |
| WO | WO 99/55964 | 11/1999 | D21H/23/04 |
| WO | WO 99/55965 | 11/1999 | D21H/23/08 |
| WO | WO 00/06490 | 2/2000 | C01B/33/14 |
| WO | WO 00/49227 | 8/2000 | D21H/21/10 |

OTHER PUBLICATIONS

Derwent Abstract 1998–015354 abstracting JP 9279498.
Partial English translation of Laid–Open Patent Gazette Japanese Patent No. 1997–279498, laid–open date Oct. 28, 1997.
Derwent Abstract 1998–037406 abstracting JP 9291491.
Partial English translation of Laid–Open Patent Gazette Japanese Patent No. 1997–291491, laid–open date Nov. 11, 1997.
International Search Report of International Application No. PCT/SE 01/01701, dated Nov. 22, 2001.
Derwent Abstract 009345899 (1993), abstracting JP 4363301.

*Primary Examiner*—Peter Chin
(74) *Attorney, Agent, or Firm*—Michelle J. Burke; Lainie E. Parker

(57) ABSTRACT

The invention relates to a process for the production of paper from an aqueous suspension containing cellulosic fibers, and optional fillers, which comprises separately adding to the suspension a cationic organic polymer having one or more aromatic groups and an anionic polymer having one or more aromatic groups, the anionic polymer being selected from step-growth polymers, polysaccharides and naturally occurring aromatic polymers and modifications thereof, forming and draining the suspension on a wire, with the proviso that if the anionic polymer is a step-growth polymer it is not an anionic melamine-sulphonic acid condensation polymer. The invention further relates to a process for the production of paper from an aqueous suspension containing cellulosic fibers, and optional fillers, which comprises separately adding to the suspension a cationic organic polymer having one or more aromatic groups and an anionic polymer having one or more aromatic groups, forming and draining the suspension on a wire, with the proviso that the anionic polymer is not an anionic polystyrene sulphonate or anionic melamine-sulphonic acid condensation polymer.

13 Claims, No Drawings

PROCESS FOR THE PRODUCTION OF PAPER

This application claims priority of EPO Application Nos. 00850195.9, filed Nov. 16, 2000, 00850135.5, filed Aug. 7, 2000, 00850136.3, filed Aug. 7, 2000, and 00850137.1, filed Aug. 7, 2000, and U.S. Provisional Application Nos. 60/249,365, filed Nov. 16, 2000, 60/223,367, filed Aug. 7, 2000, 60/223,368, filed Aug. 7, 2000, and 60/223,369, filed Aug. 7, 2000.

This invention relates to papermaking and more specifically to a process for the production of paper in which cationic and anionic polymers having aromatic groups are added to a papermaking stock. The process provides improved drainage and retention.

BACKGROUND

In the papermaking art, an aqueous suspension containing cellulosic fibres, and optional fillers and additives, referred to as stock, is fed into a headbox which ejects the stock onto a forming wire. Water is drained from the stock through the forming wire so that a wet web of paper is formed on the wire, and the web is further dewatered and dried in the drying section of the paper machine. The obtained water, usually referred to as white water and containing fine particles such as fine fibres, fillers and additives, is usually recycled in the papermaking process. Drainage and retention aids are conventionally introduced into the stock in order to facilitate drainage and increase adsorption of fine particles onto the cellulose fibres so that they are retained with the fibres. A wide variety of drainage and retention aids are known in the art, for example anionic, non-ionic, cationic and amphoteric organic polymers, anionic and cationic inorganic materials, and many combinations thereof.

International Patent Application Publication Nos. WO 99/55964 and WO 99/55965 disclose the use of drainage and retention aids comprising cationic organic polymers having aromatic groups. The cationic organic polymers can be used alone or in combination with various anionic materials such as, for example, anionic organic and inorganic condensation polymers, e.g. sulphonated melamine-formaldehyde and silica-based particles.

It would be advantageous to be able to provide a papermaking process with improved drainage and retention. It would also be advantageous to be able to provide drainage and retention aids comprising cationic organic polymers and anionic polymers with improved drainage and retention performance.

THE INVENTION

According to the present invention it has been found that improved drainage and/or retention can be obtained by using drainage and retention aids comprising a cationic organic polymer having an aromatic group and an anionic polymer having an aromatic group. More specifically, the present invention relates to a process for the production of paper from an aqueous suspension containing cellulosic fibres, and optional fillers, which comprises separately adding to the suspension a cationic organic polymer having an aromatic group and an anionic polymer having an aromatic group, the anionic polymer being selected from step-growth polymers, polysaccharides, and naturally occurring aromatic polymers and modifications thereof; forming and draining the suspension on a wire, with the proviso that if the anionic polymer is selected from step-growth polymers, it is not an anionic melamine-sulphonic acid condensation polymer. The invention further relates to a process for the production of paper from an aqueous suspension containing cellulosic fibres, and optional fillers, which comprises separately adding to the suspension a cationic organic polymer having an aromatic group and an anionic polymer having an aromatic group, forming and draining the suspension on a wire, with the proviso that the anionic polymer is not an anionic polystyrene sulphonate or anionic melamine-sulphonic acid condensation polymer. The invention thus relates to a process as further defined in the claims.

The term "drainage and retention aids", as used herein, refers to two or more components which, when added to an aqueous cellulosic suspension, give better drainage and/or retention than is obtained when not adding the said two or more components.

The present invention results in improved drainage and/or retention in the production of paper from all types of stocks, in particular stocks having high contents of salts (high conductivity) and colloidal substances, and/or in papermaking processes with a high degree of white water closure, i.e. extensive white water recycling and limited fresh water supply. Hereby the present invention makes it possible to increase the speed of the paper machine and to use a lower dosage of additives to give a corresponding drainage and/or retention effect, thereby leading to an improved papermaking process and economic benefits. The present invention also provides paper with improved dry strength.

The cationic organic polymer having an aromatic group according to the present invention can be derived from natural or synthetic sources, and it can be linear, branched or cross-linked. Preferably the cationic polymer is water-soluble or water-dispersable. Examples of suitable cationic polymers include cationic polysaccharides, e.g. starches, guar gums, celluloses, chitins, chitosans, glycans, galactans, glucans, xanthan gums, pectins, mannans, dextrins, preferably starches and guar gums, suitable starches including potato, corn, wheat, tapioca, rice, waxy maize, barley, etc.; cationic synthetic organic polymers such as cationic chain-growth polymers, e.g. cationic vinyl addition polymers like acrylate-, acrylamide-, vinylamine- and vinylamide-based polymers, and cationic step-growth polymers, e.g. cationic polyurethanes. Cationic starches and cationic acrylamide-based polymers having an aromatic group are particularly preferred cationic polymers.

The cationic organic polymer according to the invention has one or more aromatic groups and the aromatic groups can be of the same or different types. The aromatic group of the cationic organic polymer can be present in the polymer backbone (main chain) or in a substituent group that is attached to the polymer backbone, preferably in a substituent group. Examples of suitable aromatic groups include aryl, aralkyl and alkaryl groups, e.g. phenyl, phenylene, naphthyl, phenylene, xylylene, benzyl and phenylethyl; nitrogen-containing aromatic (aryl) groups, e.g. pyridinium and quinolinium, as well as derivatives of these groups, preferably benzyl. Examples of cationically charged groups that can be present in the cationic polymer as well as in monomers used for preparing the cationic polymer include quaternary ammonium groups, tertiary amino groups and acid addition salts thereof.

According to a preferred embodiment of this invention, the cationic organic polymer having an aromatic group is a polysaccharide represented by the general structural formula (I):

(I)

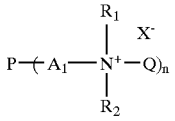

wherein P is a residue of a polysaccharide; $A_1$ is a group attaching N to the polysaccharide residue, suitably a chain of atoms comprising C and H atoms, and optionally O and/or N atoms, usually an alkylene group with from 2 to 18 and suitably 2 to 8 carbon atoms, optionally interrupted or substituted by one or more heteroatoms, e.g. O or N, e.g. an alkyleneoxy group or hydroxy propylene group (—$CH_2$—CH(OH)—$CH_2$—); $R_1$ and $R_2$ are each H or, preferably, a hydrocarbon group, suitably alkyl, having from 1 to 3 carbon atoms, preferably 1 to 2 carbon atoms; Q is a substituent containing an aromatic group, suitably a phenyl or substituted phenyl group, which can be attached to the nitrogen by means of an alkylene group usually having from 1 to 3 carbon atoms, suitably 1 to 2 carbon atoms, and preferably Q is a benzyl group (—$CH_2$—$C_6H_5$); n is an integer, usually from about 2 to about 300,000, suitably from 5 to 200,000 and preferably from 6 to 125,000 or, alternatively, $R_1$, $R_2$ and Q together with N form a aromatic group containing from 5 to 12 carbon atoms; and $X^-$ is an anionic counterion, usually a halide like chloride. Suitable polysaccharides represented by the general formula (I) include those mentioned above. Cationic polysaccharides according to the invention may also contain anionic groups, preferably in a minor amount. Such anionic groups may be introduced in the polysaccharide by means of chemical treatment or be present in the native polysaccharide.

According to another preferred embodiment of this invention, the cationic organic polymer having an aromatic group is a chain-growth polymer. The term "chain-growth polymer", as used herein, refers to a polymer obtained by chain-growth polymerization, also being referred to as chain reaction polymer and chain reaction polymerization, respectively. Examples of suitable chain-growth polymers include vinyl addition polymers prepared by polymerization of one or more monomers having a vinyl group or ethylenically unsaturated bond, for example a polymer obtained by polymerizing a cationic monomer or a monomer mixture comprising a cationic monomer represented by the general structural formula (II):

(II)

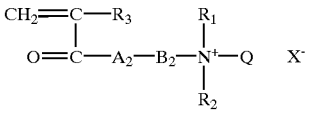

wherein $R_3$ is H or $CH_3$; $R_1$ and $R_2$ are each H or, preferably, a hydrocarbon group, suitably alkyl, having from 1 to 3 carbon atoms, preferably 1 to 2 carbon atoms; $A_2$ is 0 or NH; $B_2$ is an alkyl or alkylene group having from 2 to 8 carbon atoms, suitably from 2 to 4 carbon atoms, or a hydroxy propylene group; Q is a substituent containing an aromatic group, suitably a phenyl or substituted phenyl group, which can be attached to the nitrogen by means of an alkylene group usually having from 1 to 3 carbon atoms, suitably 1 to 2 carbon atoms, and preferably Q is a benzyl group (—$CH_2$—$C_6H_5$); and $X^-$ is an anionic counterion, usually a halide like chloride.

Examples of suitable monomers represented by the general formula (II) include quaternary monomers obtained by treating dialkylaminoalkyl (meth)acrylates, e.g. dimethylaminoethyl (meth)acrylate, diethylaminoethyl (meth) acrylate and dimethylaminohydroxy-propyl (meth)acrylate, and dialkylaminoalkyl (meth)acrylamides, e.g. dimethylaminoethyl (meth)acrylamide, diethylaminoethyl (meth) acrylamide, dimethylaminopropyl (meth)acrylamide, and diethylaminopropyl (meth)acrylamide, with benzyl chloride. Preferred cationic monomers of the general formula (I) include dimethylaminoethylacrylate benzyl chloride quatemary salt and dimethylaminoethylmethacrylate benzyl chloride quatemary salt. The monomer of formula (II) can be copolymerized with one or more non-ionic, cationic and/or anionic monomers. Suitable copolymerizable non-ionic monomers include (meth)acrylamide; acrylamide-based monomers like N-alkyl (meth)acrylamides, N,N-dialkyl (meth)acrylamides and dialkylaminoalkyl (meth) acrylamides, acrylate-based monomers like dialkylaminoalkyl (meth)acrylates, and vinylamides. Suitable copolymerizable cationic monomers include acid addition salts and quaternary salts of dimethylaminoethyl (meth)acrylate and diallyldimethylammonium chloride. The cationic organic polymer may also contain anionic groups, preferably in a minor amount. Suitable copolymerizable anionic monomers include acrylic acid, methacrylic acid and various sulphonated vinylic monomers such as styrenesulphonate. Preferred copolymerizable monomers include acrylamide and methacrylamide, i.e. (meth)acrylamide, and the cationic or amphoteric organic polymer is preferably an acrylamide-based polymer.

Cationic vinyl addition polymers according to this invention can be prepared from a monomer mixture generally comprising from 1 to 99 mole %, suitably from 2 to 50 mole % and preferably from 5 to 20 mole % of cationic monomer having an aromatic group and from 99 to 1 mole %, suitably from 98 to 50 mole %, and preferably from 95 to 80 mole % of other copolymerizable monomers which preferably comprises acrylamide or methacrylamide ((meth) acrylamide), the monomer mixture suitably comprising from 98 to 50 mole % and preferably from 95 to 80 mole % of (meth)acrylamide, the sum of percentages being 100.

Examples of suitable cationic step-growth polymers according to the invention include cationic polyurethanes which can be prepared from a monomer mixture comprising aromatic isocyanates and/or aromatic alcohols. Examples of suitable aromatic isocyanates include diisocyanates, e.g. toluene-2,4- and 2,6-diisocyanates and diphenylmethane4, 4'-diisocyanate. Examples of suitable aromatic alcohols include dihydric alcohols, i.e. diols, e.g. bisphenol A, phenyl diethanol amine, glycerol monoterephthalate and trimethylolpropane monoterephthalate. Monohydric aromatic alcohols such as phenol and derivaties thereof may also be employed. The monomer mixture can also contain non-aromatic isocyanates and/or alcohols, usually diisocyanates and diols, for example any of those known to be useful in the preparation of polyurethanes. Examples of suitable monomers containing cationic groups include cationic diols such as acid addition salts and quaternization products of N-alkandiol dialkylamines and N-alkyl dialkanolamines like 1,2-propanediol-3-dimethylamine, N-methyl diethanolamine, N-ethyl diethanolamine, N-propyl diethanolamine, N-n-butyl diethanolamine and N-t-butyl diethanolamine, N-stearyl diethanolamine and N-methyl dipropanolamine. The quaternization products can be derived from alkylating agents like methyl chloride, dimethyl sulphate, benzyl chloride and epichlorohydrin.

The weight average molecular weight of the cationic polymer can vary within wide limits dependent on, inter alia, the type of polymer used, and usually it is at least about 5,000 and often at least 10,000. More often, it is above 150,000, normally above 500,000, suitably above about 700,000, preferably above about 1,000,000 and most preferably above about 2,000,000. The upper limit is not critical; it can be about 200,000,000, usually 150,000,000 and suitably 100,000,000.

The cationic organic polymer can have a degree of cationic substitution ($DS_C$) varying over a wide range dependent on, inter alia, the type of polymer used; $DS_C$ can be from 0.005 to 1.0, usually from 0.01 to 0.5, suitably from 0.02 to 0.3, preferably from 0.025 to 0.2; and the degree of aromatic substitution ($DS_Q$) can be from 0.001 to 0.5, usually from 0.01 to 0.5, suitably from 0.02 to 0.3 and preferably from 0.025 to 0.2. In case the cationic organic polymer contains anionic groups, the degree of anionic substitution ($DS_A$) can be from 0 to 0.2, suitably from 0 to 0.1 and preferably from 0 to 0.05, the cationic polymer having an overall cationic charge. Usually the charge density of the cationic polymer is within the range of from 0.1 to 6.0 meqv/g of dry polymer, suitably from 0.2 to 5.0 and preferably from 0.5 to 4.0.

Examples of suitable cationic organic polymers having an aromatic group that can be used according to the present invention include those described in International Patent Publication Nos. WO 99/55964, WO 99/55965 and WO 99/67310, which are hereby incorporated herein by reference.

Anionic polymers having an aromatic group according to the invention can be selected from step-growth polymers, chain-growth polymers, polysaccharides, naturally occurring aromatic polymers and modifications thereof. The term "step-growth polymer", as used herein, refers to a polymer obtained by step-growth polymerization, also being referred to as step-reaction polymer and step-reaction polymerization, respectively. Preferably the anionic polymer is selected from step-growth polymers, polysaccharides and naturally occurring aromatic polymers and modifications thereof, most preferably step-growth polymers. The anionic polymers according to the invention can be linear, branched or cross-linked. Preferably the anionic polymer is water-soluble or water-dispersable. The anionic polymer is preferably organic.

The anionic polymer according to the invention has one or more aromatic groups and the aromatic groups can be of the same or different types. The aromatic group of the anionic polymer can be present in the polymer backbone or in a substituent group that is attached to the polymer backbone (main chain). Examples of suitable aromatic groups include aryl, aralkyl and alkaryl groups and derivatives thereof, e.g. phenyl, tolyl, naphthyl, phenylene, xylylene, benzyl, phenylethyl and derivatives of these groups. Examples of anionically charged groups that can be present in the anionic polymer as well as in the monomers used for preparing the anionic polymer include groups carrying an anionic charge and acid groups carrying an anionic charge when dissolved or dispersed in water, the groups herein collectively being referred to as anionic groups, such as phosphate, phosphonate, sulphate, sulphonic acid, sulphonate, carboxylic acid, carboxylate, alkoxide and phenolic groups, i.e. hydroxy-substituted phenyls and naphthyls. Groups carrying an anionic charge are usually salts of an alkali metal, alkaline earth or ammonia.

Examples of suitable anionic step-growth polymers according to the present invention include condensation polymers, i.e. polymers obtained by step-growth condensation polymerization, e.g. condensates of an aldehyde such as formaldehyde with one or more aromatic compounds containing one or more anionic groups, and optional other comonomers useful in the condensation polymerization such as urea and melamine. Examples of suitable aromatic compounds containing anionic groups comprises benzene and naphthalene-based compounds containing anionic groups such as phenolic and naphtholic compounds, e.g. phenol, naphthol, resorcinol and derivatives thereof, aromatic acids and salts thereof, e.g. phenylic, phenolic, naphthylic and naphtholic acids and salts, usually sulphonic acids and sulphonates, e.g. benzene sulphonic acid and sulphonate, xylen sulphonic acid and sulphonates, naphthalene sulphonic acid and sulphonate, phenol sulphonic acid and sulphonate. Examples of suitable anionic step-growth polymers according to the invention include anionic benzene-based and naphthalene-based condensation polymers, preferably naphthalene-sulphonic acid based and naphthalene-sulphonate based condensation polymers.

Examples of further suitable anionic step-growth polymers according to the present invention include addition polymers, i.e. polymers obtained by step-growth addition polymerization, e.g. anionic polyurethanes which can be prepared from a monomer mixture comprising aromatic isocyanates and/or aromatic alcohols. Examples of suitable aromatic isocyanates include diisocyanates, e.g. toluene-2,4- and 2,6-diisocyanates and diphenylmethane-4,4'-diisocyanate. Examples of suitable aromatic alcohols include dihydric alcohols, i.e. diols, e.g. bisphenol A, phenyl diethanol amine, glycerol monoterephthalate and trimethylolpropane monoterephthalate. Monohydric aromatic alcohols such as phenol and derivaties thereof may also be employed. The monomer mixture can also contain non-aromatic isocyanates and/or alcohols, usually diisocyanates and diols, for example any of those known to be useful in the preparation of polyurethanes. Examples of suitable monomers containing anionic groups include the monoester reaction products of triols, e.g. trimethylolethane, trimethylolpropane and glycerol, with dicarboxylic acids or anhydrides thereof, e.g. succinic acid and anhydride, terephthalic acid and anhydride, such as glycerol monosuccinate, glycerol monoterephthalate, trimethylolpropane monosuccinate, trimethylolpropane monoterephthalate, N,N-bis-(hydroxyethyl)-glycine, di-(hydroxymethyl)propionic acid, N,N-bis-(hydroxyethyl)-2-aminoethanesulphonic acid, and the like, optionally and usually in combination with reaction with a base, such as alkali metal and alkaline earth hydroxides, e.g. sodium hydroxide, ammonia or an amine, e.g. triethylamine, thereby forming an alkali metal, alkaline earth or ammonium counter-ion.

Examples of suitable anionic chain-growth polymers according to the invention include anionic vinyl addition polymers obtained from a mixture of vinylic or ethylenically unsaturated monomers comprising at least one monomer having an aromatic group and at least one monomer having an anionic group, usually co-polymerized with non-ionic monomers such as acrylate- and acrylamide-based monomers. Examples of suitable anionic monomers include (meth)acrylic acid and paravinyl phenol (hydroxy styrene).

Examples of suitable anionic polysaccharides include starches, guar gums, celluloses, chitins, chitosans, glycans, galactans, glucans, xanthan gums, pectins, mannans, dextrins, preferably starches, guar gums and cellulose derivatives, suitable starches including potato, corn, wheat, tapioca, rice, waxy maize and barley, preferably potato. The anionic groups in the polysaccharide can be native and/or introduced by chemical treatment. The aromatic groups in the polysaccharide can be introduced by chemical methods known in the art.

Naturally occurring aromatic anionic polymers and modifications thereof, i.e. modified naturally occurring aromatic anionic polymers, according to the invention include naturally occuring polyphenolic substances that are present in wood and organic extracts of bark of some wood species and chemical modifications thereof, usually sulphonated modifications thereof. The modified polymers can be obtained by chemical processes such as, for example, sulphite pulping and kraft pulping. Examples of suitable anionic polymers of this type include lignin-based polymers, preferably sulphonated lignins, e.g. lignosulphonates, kraft lignin, sulphonated kraft lignin, and tannin extracts.

The weight average molecular weight of the anionic polymer can vary within wide limits dependent on, inter alia, the type of polymer used, and usually it is at least about 500, suitably above about 2,000 and preferably above about 5,000. The upper limit is not critical; it can be about 200,000,000, usually 150,000,000, suitably 100,000,000 and preferably 10,000,000.

The anionic polymer can have a degree of anionic substitution ($DS_A$) varying over a wide range dependent on, inter alia, the type of polymer used; $DS_A$ is usually from 0.01 to 2.0, suitably from 0.02 to 1.8 and preferably from 0.025 to 1.5; and the degree of aromatic substitution ($DS_Q$) can be from 0.001 to 1.0, usually from 0.01 to 0.8, suitably from 0.02 to 0.7 and preferably from 0.025 to 0.5. In case the anionic polymer contains cationic groups, the degree of cationic substitution ($DS_C$) can be, for example, from 0 to 0.2, suitably from 0 to 0.1 and preferably from 0 to 0.05, the anionic polymer having an overall anionic charge. Usually the anionic charge density of the anionic polymer is within the range of from 0.1 to 6.0 meqv/g of dry polymer, suitably from 0.5 to 5.0 and preferably from 1.0 to 4.0.

Examples of suitable anionic aromatic polymers that can be used according to the present invention include those described in U.S. Pat. Nos. 4,070,236 and 5,755,930; and International Patent Application Publication Nos. WO 95/21295, WO 95/21296, WO 99/67310 and WO 00/49227, which are hereby incorporated herein by reference.

Examples of particularly preferred combinations of anionic and cationic polymers having aromatic groups, as defined above, according to the present invention include (i) cationic polysaccharides, preferably cationic starch, and anionic step-growth polymers, suitably anionic benzene-based and naphthalene-based condensation polymers and anionic polyurethanes, preferably anionic naphthalene-based condensation polymers;

(ii) cationic polysaccharides, preferably cationic starch, and naturally occurring aromatic anionic polymers and modifiations thereof, suitably anionic lignin-based polymers, preferably sulphonated lignins;

(iii) cationic chain-growth polymers, suitably cationic vinyl addition polymers, preferably cationic acrylamide-based polymers, and anionic step-growth polymers, suitably anionic benzene-based and naphthalene-based condensation polymers and anionic polyurethanes, preferably anionic naphthalene-based condensation polymers; and (iv) cationic chain-growth polymers, suitably cationic vinyl addition polymers, preferably cationic acrylamide-based polymers, and naturally occurring aromatic anionic polymers and modifiations thereof, suitably anionic lignin-based polymers, preferably sulphonated lignins.

The cationic and anionic polymers according to the invention are preferably separately added to the aqueous suspension containing cellulosic fibres, or stock, and not as a mixture containing said polymers. Preferably the cationic and anionic polymers are added to the stock at different points. The polymers can be added in any order. Usually the cationic polymer is firstly added to the stock and the anionic polymer is subsequently added, although the reverse order of addition may also be used. The polymers can be added to the stock to be dewatered in amounts which can vary within wide limits depending on, inter alia, type of stock, salt content, type of salts, filler content, type of filler, point of addition, etc. Generally the polymers are added in an amount that give better drainage and/or retention than is obtained when not adding them and usually the cationic polymer is added to the stock prior to adding the anionic polymer. The cationic polymer is usually added in an amount of at least 0.001%, often at least 0.005% by weight, based on dry stock substance, whereas the upper limit is usually 3% and suitably 2.0% by weight. The anionic polymer is usually added in an amount of at least 0.001%, often at least 0.005% by weight, based on dry stock substance, whereas the upper limit is usually 3% and suitably 1.5% by weight.

The polymers having aromatic groups according to the invention can be used in conjunction with additional additive(s) that are beneficial to the overall drainage and/or retention performance, thereby forming drainage and retention aids comprising three or more components. Examples of suitable stock additives of this type include anionic microparticulate materials, e.g., silica-based particles and clays of smectite type, low molecular weight cationic organic polymers, aluminium compounds, anionic vinyl addition polymers and combinations thereof, including the compounds and the use thereof disclosed in International Patent Application Publication Nos. WO 99/55964 and WO 99/55965, which are incorporated herein by reference.

Low molecular weight (hereinafter LMW) cationic organic polymers that can be used according to the invention include those commonly referred to as anionic trash catchers (ATC). The LMW cationic organic polymer can be derived from natural or synthetic sources, and preferably it is an LMW synthetic polymer. Suitable organic polymers of this type include LMW highly charged cationic organic polymers such as polyamines, polyamidoamines, polyethyleneimines, homo- and copolymers based on diallyldimethyl ammonium chloride, (meth)acrylamides and (meth)acrylates. In relation to the molecular weight of the cationic organic polymer having an aromatic group of this invention, the molecular weight of the LMW cationic organic polymer is preferably lower; it is suitably at least 2,000 and preferably at least 10,000. The upper limit of the molecular weight is usually about 700,000, suitably about 500,000 and usually about 200,000.

Aluminium compounds that can be used according to the invention include alum, aluminates, aluminium chloride, aluminium nitrate and polyaluminium compounds, such as polyaluminium chlorides, polyaluminium sulphates, polyaluminium compounds containing both chloride and sulphate ions, polyaluminium silicate-sulphates, and mixtures thereof. The polyaluminium compounds may also contain other anions than chloride ions, for example anions from sulphuric acid, phosphoric acid, organic acids such as citric acid and oxalic acid.

The process of this invention is applicable to all papermaking processes and cellulosic suspensions, and it is particularly useful in the manufacture of paper from a stock that has a high conductivity. In such cases, the conductivity of the stock that is dewatered on the wire is usually at least 2.0 mS/cm, suitably at least 3.5 mS/cm, and preferably at least 5.0 mS/cm. Conductivity can be measured by standard equipment such as, for example, a WTW LF 539 instrument supplied by Christian Berner. The values referred to above are suitably determined by measuring the conductivity of the cellulosic suspension that is fed into or present in the headbox of the paper machine or, alternatively, by measuring the conductivity of white water obtained by dewatering the suspension. High conductivity levels mean high contents of salts (electrolytes) which can be derived from the materials used to form the stock, from various additives introduced into the stock, from the fresh water supplied to the process, etc. Further, the content of salts is usually higher in processes where white water is extensively recirculated, which may lead to considerable accumulation of salts in the water circulating in the process.

The present invention further encompasses papermaking processes where white water is extensively recycled, or recirculated, i.e. with a high degree of white water closure, for example where from 0 to 30 tons of fresh water are used per ton of dry paper produced, usually less than 20, suitably less than 15, preferably less than 10 and notably less than 5 tons of fresh water per ton of paper. Recycling of white water obtained in the process suitably comprises mixing the white water with cellulosic fibres and/or optional fillers to form a suspension to be dewatered; preferably it comprises mixing the white water with a suspension containing cellulosic fibres, and optional fillers, before the suspension enters the forming wire for dewatering. The white water can be mixed with the suspension before, between, simultaneous with or after introducing the drainage and retention aids of this invention. Fresh water can be introduced in the process at any stage; for example, it can be mixed with cellulosic fibres in order to form a suspension, and it can be mixed with a thick suspension containing cellulosic fibres to dilute it so as to form a thin suspension to be dewatered, before, simultaneous with or after mixing the suspension with white water.

Further additives which are conventional in papermaking can of course be used in combination with the polymers according to the invention, such as, for example, dry strength agents, wet strength agents, optical brightening agents, dyes, sizing agents like rosin-based sizing agents and cellulose-reactive sizing agents, e.g. alkyl and alkenyl ketene dimers, alkyl and alkenyl ketene multimers, and succinic anhydrides, etc. The cellulosic suspension, or stock, can also contain mineral fillers of conventional types such as, for example, kaolin, china clay, titanium dioxide, gypsum, talc and natural and synthetic calcium carbonates such as chalk, ground marble and precipitated calcium carbonate.

The process of this invention is used for the production of paper. The term "paper", as used herein, of course include not only paper and the production thereof, but also other cellulosic fibre-containing sheet or web-like products, such as for example board and paperboard, and the production thereof. The process can be used in the production of paper from different types of suspensions of cellulose-containing fibres and the suspensions should suitably contain at least 25% by weight and preferably at least 50% by weight of such fibres, based on dry substance. The suspension can be based on fibres from chemical pulp such as sulphate, sulphite and organosolv pulps, mechanical pulp such as thermomechanical pulp, chemo-thermomechanical pulp, refiner pulp and groundwood pulp, from both hardwood and softwood, and can also be based on recycled fibres, optionally from de-inked pulps, and mixtures thereof.

The invention is further illustrated in the following Examples which, however, are not intended to limit the same. Parts and % relate to parts by weight and % by weight, respectively, unless otherwise stated.

EXAMPLE 1

Cationic polymers used in the tests were purchased on the market or prepared by generally known procedures. The cationic polysaccharides used in the tests were prepared by reacting native potato starch with a quaternising agent according to the general procedure described in EP-A 0 189 935 and WO 99/55964. The cationic polymers used in the tests, hereinafter also collectively referred to as cationic polymer, C1 to C3 according to the invention and C1-ref to C3-ref intended for comparison purposes, were the following:

C1: Cationic starch obtained by quaternization of native potato starch with 3-chloro-2-hydroxypropyl dimethyl benzyl ammonium chloride to 0.5% N.

C2: Cationic starch obtained by quaternization of native potato starch with 3-chloro-2-hydroxypropyl dimethyl benzyl ammonium chloride to 0.7% N.

C3: Cationic vinyl addition polymer prepared by polymerisation of acrylamide (90 mole %) and acryloxyethyldimethylbenzylammonium chloride (10 mole %), molecular weight about 6,000,000.

C1-ref: Cationic starch obtained by quarternization of native potato starch with 2,3-epoxypropyl trimethyl ammonium chloride to 0.8% N.

C2-ref: Cationic starch obtained by quarternization of native potato starch with 2,3-epoxypropyl trimethyl ammonium chloride to 0.5% N.

C3-ref: Cationic vinyl addition polymer prepared by polymerisation of acrylamide (90 mole %) and acryloxyethyltrimethylammonium chloride (10 mole %), molecular weight about 6,000,000.

Anionic polymers used in the tests were purchased on the market or prepared by generally known procedures. The anionic polymers used in the tests, hereinafter also collectively referred to as anionic polymer, A1 to A8 according to the invention and A1-ref to A2-ref intended for comparison purposes, were the following:

A1: Anionic polycondensate of formaldehyde with naphthalene sulphonate, molecular weight about 20,000.

A2: Anionic polycondensate of formaldehyde with naphthalene sulphonate, molecular weight about 110,000.

A3: Anionic polycondensate of formaldehyde with naphthalene sulphonate, molecular weight about 40,000.

A4: Anionic polycondensate of formaldehyde with naphthalene sulphonate, molecular weight about 210,000.

A5: Anionic polyurethane obtained by reacting glycerol monostearate with toluene diisocyanate to form a prepolymer containing terminal isocyanate groups which is then reacted with dimethylol propionic acid.

A6: Anionic polyurethane obtained by reacting phenyl diethanol amine with toluene diisocyanate to form a pre-polymer containing terminal isocyanate groups which is then reacted with dimethylol propionic acid and N-methyl diethanol amine.

A7: Anionic sulphonated kraft lignin.

A8: Anionic lignosulphonate.

A1-ref: Anionic melamine-formaldehyde-sulphonate polycondensate.

A2-ref: Anionic inorganic condensation polymer of silicic acid in the form of colloidal silica particles with a particle size of 5 nm.

A low molecular weight cationic organic polymer, also referred to as ATC, which was used in some of the tests, was available on the market and producible by generally known procedures. The ATC was the following:

ATC: Cationic copolymer of dimethylamine, epichlorohydrin and ethylene diamine with a molecular weight of about 50,000.

All polymers were used in the form of dilute aqueous polymer solutions.

EXAMPLE 2

Drainage performance was evaluated by means of a Dynamic Drainage Analyser (DDA), available from Akribi, Sweden, which measures the time for draining a set volume of stock through a wire when removing a plug and applying vacuum to that side of the wire opposite to the side on which the stock is present.

A standard stock was prepared from a furnish based on 56% by weight of peroxide bleached TMP/SGW pulp (80/20), 14% by weight of bleached birch/pine sulphate pulp (60/40) refined to 200° CSF and 30% by weight of china clay. To the stock was added 25 g/l of a colloidal fraction, bleach water from a paper mill. Stock volume was 800 ml and pH about 7. Calcium chloride was added to the stock to adjust the conductivity to 0.5 mS/cm. The obtained stock is referred to as standard stock. Additional amounts of calcium chloride were added to the standard stock in order to prepare a medium conductivity stock (2.0 mS/cm) and a high conductivity stock (5.0 mS/cm).

The stock was stirred in a baffled jar at a speed of 1500 rpm throughout the test and chemicals additions were conducted as follows: i) adding cationic polymer to the stock following by stirring for 30 seconds, ii) adding anionic polymer to the stock followed by stirring for 15 seconds, iii) draining the stock while automatically recording the drainage time. If used, the ATC was added to the stock followed by stirring for 30 seconds prior to i) adding cationic polymer and ii) adding anionic polymer according to the procedure described above.

Table 1 shows the dewatering (drainage) effect at various dosages of the cationic polymer C1, calculated as dry polymer on dry stock system, and various dosages of the ionic polymers A1-ref, A1 and A2, calculated as dry polymer on dry stock system. The standard stock was used in Test Nos. 1–5 and the high conductivity stock was used in Test Nos. 6–9.

TABLE 1

| Test | C1 Dosage | A Dosage | Dewatering time [s] | | |
|---|---|---|---|---|---|
| No. | [kg/t] | [kg/t] | A1-ref | A1 | A2 |
| 1 | 30 | 0 | 19.0 | 19.0 | 19.0 |
| 2 | 30 | 0.5 | 17.5 | 17.0 | 15.5 |
| 3 | 30 | 1.0 | 14.6 | 12.6 | 12.1 |
| 4 | 30 | 2.0 | 12.8 | 9.0 | 8.4 |
| 5 | 30 | 3.0 | 9.8 | 8.7 | 7.2 |
| 6 | 20 | 0 | 26.4 | 26.4 | 26.4 |
| 7 | 20 | 2.0 | 21.5 | 15.7 | 15.6 |
| 8 | 20 | 3.0 | 17.6 | 14.6 | 13.7 |
| 9 | 20 | 4.0 | 15.7 | 14.5 | 13.4 |

EXAMPLE 3

First pass retention was evaluated by means of a nephelometer by measuring the turbidity of the filtrate from the Dynamic Drainage Analyser (DDA), the white water, obtained by draining the stock obtained in Example 2. The results are shown in Table 2.

TABLE 2

| Test | C1 Dosage | A Dosage | Turbidity [NTU] | | |
|---|---|---|---|---|---|
| No. | [kg/t] | [kg/t] | A1-ref | A1 | A2 |
| 1 | 30 | 0.5 | 56 | 49 | 55 |
| 2 | 30 | 1.0 | 55 | 50 | 50 |
| 3 | 30 | 2.0 | 52 | 47 | 48 |
| 4 | 30 | 3.0 | 50 | 43 | 45 |

EXAMPLE 4

Drainage performance was evaluated using the cationic and anionic polymers according to Example 1 and the standard stock and procedure according to Example 2. The results are shown in Table 3.

TABLE 3

| Test | C1 Dosage | A Dosage | Dewatering time [s] | | |
|---|---|---|---|---|---|
| No. | [kg/t] | [kg/t] | A1 | A3 | A4 |
| 1 | 0 | 0 | 18.0 | 18.0 | 18.0 |
| 2 | 20 | 0 | 12.5 | 12.5 | 12.5 |
| 3 | 20 | 1.0 | 10.9 | 10.0 | 10.2 |
| 4 | 20 | 2.0 | 10.3 | 9.0 | 8.9 |
| 5 | 20 | 4.0 | 10.0 | 8.7 | 8.0 |

EXAMPLE 5

Drainage performance was evaluated using the cationic and anionic polymers according to Example 1 and the medium conductivity stock and procedure according to Example 2. The results are shown in Table 4.

TABLE 4

| Test | C Dosage | A1 Dosage | Dewatering time [s] | | |
|---|---|---|---|---|---|
| No. | [kg/t] | [kg/t] | C1-ref | A1 | A2 |
| 1 | 10 | 0 | 13.8 | 14.6 | 11.5 |
| 2 | 10 | 0.75 | 12.6 | 10.6 | 7.4 |
| 3 | 10 | 1.5 | 12.8 | 9.5 | 6.6 |
| 4 | 10 | 3.0 | 14.1 | 10.1 | 7.2 |

EXAMPLE 6

Drainage performance was evaluated using the cationic and anionic polymers according to Example 1 and the high conductivity stock and procedure according to Example 2. The results are shown in Table 5.

TABLE 5

| Test | C1 Dosage | A Dosage | Dewatering time [s] | | |
|---|---|---|---|---|---|
| No. | [kg/t] | [kg/t] | A2-ref | A5 | A6 |
| 1 | 20 | 0 | 31.8 | 31.8 | 31.8 |
| 2 | 20 | 1.0 | 31.0 | 27.5 | 28.8 |
| 3 | 20 | 2.0 | 28.0 | 22.0 | 24.4 |
| 4 | 20 | 4.0 | 23.8 | 16.5 | 19.5 |
| 5 | 20 | 6.0 | 23.0 | 14.0 | 18.3 |

EXAMPLE 7

Darinage performance was evaluated using the cationic and anionic polymers according to Example 1 and the high conductivity stock and procedure according to Example 2. The results are shown in Table 6.

TABLE 6

| Test | C3 Dosage | A Dosage | Dewatering time [s] | |
|---|---|---|---|---|
| No. | [kg/t] | [kg/t] | A5 | A6 |
| 1 | 2 | 0 | 15.8 | 15.8 |
| 2 | 2 | 0.25 | 13.8 | 13.3 |
| 3 | 2 | 0.5 | 13.2 | 12.9 |
| 4 | 2 | 0.75 | 13.4 | 13.1 |
| 5 | 2 | 1.0 | 13.5 | 13.3 |

EXAMPLE 8

Drainage and retention performance was evaluated using the cationic and anionic polymers according to Example 1 and the standard conductivity stock and procedures according to Examples 2 and 3. The results are shown in Table 7.

TABLE 7

| Test | C Dosage | A7 Dosage | Dewatering time/Turbidity [s]/NTU | |
|---|---|---|---|---|
| No. | [kg/t] | [kg/t] | C2-ref | C1 |
| 1 | 25 | 0 | 22.0/49 | 23.4/43 |
| 2 | 25 | 2 | 22.1/50 | 16.3/40 |
| 3 | 25 | 4 | 21.2/46 | 14.3/40 |

EXAMPLE 9

Drainage performance was evaluated using the cationic and anionic polymers and ATC according to Example 1 and the medium conductivity stock and procedure according to Example 2. The results are shown in Table 8.

TABLE 8

| Test | ATC Dosage | C Dosage | A7 Dosage | Dewatering time [s] | |
|---|---|---|---|---|---|
| No. | [kg/t] | [kg/t] | [kg/t] | C3-ref | C3 |
| 1 | 3 | 3 | 1 | 20.8 | 11.0 |
| 2 | 3 | 3 | 1.5 | 17.9 | 9.3 |
| 3 | 3 | 3 | 2 | 14.7 | 7.9 |

EXAMPLE 10

Drainage and retention performance was evaluated using the cationic and anionic polymers and ATC according to Example 1 and the medium conductivity stock and procedures according to Examples 2 and 3. The results are shown in Table 9.

TABLE 9

| Test | ATC Dosage | C Dosage | A8 Dosage | Dewatering time/Turbidity [s]/NTU | |
|---|---|---|---|---|---|
| No. | [kg/t] | [kg/t] | [kg/t] | C3-ref | C3 |
| 1 | 3 | 3 | 2 | 21.4/49 | 11.1/40 |
| 2 | 3 | 3 | 3 | 17.4/46 | 9.3/40 |
| 3 | 3 | 3 | 4 | 15.6/48 | 8.9/45 |

EXAMPLE 11

Drainage performance was evaluated using the cationic and anionic polymers according to Example 1 and the standard conductivity stock and procedures according to Example 2. The results are shown in Table 10.

TABLE 10

| Test | C Dosage | A8 Dosage | Dewatering time/Turbidity [s]/NTU | |
|---|---|---|---|---|
| No. | [kg/t] | [kg/t] | C2-ref | C1 |
| 1 | 25 | 1 | 23.0/47 | 20.8/44 |
| 2 | 25 | 2 | 22.6/50 | 19.0/43 |
| 3 | 25 | 4 | 22.8/49 | 18.8/45 |
| 4 | 25 | 6 | 22.6/49 | 16.3/40 |
| 5 | 25 | 8 | 22.1/50 | 15.5/42 |

What is claimed is:

1. A process for the production of paper from an aqueous suspension containing cellulosic fibers, and optional fillers, which comprises separately adding to the suspension (i) a cationic organic polymer having one or more aromatic groups and having at least one quaternary ammonium group, the cationic organic polymer being a cationic polysaccharide and being added in an amount of at least 0.001% by weight based on dry cellulosic fibers and optional fillers; and (ii) an anionic polymer having one or more aromatic groups, the anionic polymer being added in an amount of at least 0.001% by weight based on dry cellulosic fibers and optional fillers, and the anionic polymer being a formaldehyde-naphthalene sulfonate condensation polymer;

and forming and draining the obtained suspension on a wire.

2. The process of claim 1, wherein the cationic organic polymer has a weight average molecular weight above about 1,000,000.

3. The process of claim 1, wherein the anionic polymer is prepared from one or more aromatic compounds selected from the group consisting of phenyl, phenol, naphthalene, naphthol, and mixtures thereof.

4. The process of claim 1, wherein the anionic polymer has a weight average molecular weight within the range of from 500 to 1,000,000.

5. The process of claim 1, wherein the suspension has a conductivity of at least 2.0 mS/cm.

6. The process of claim 1 further comprising adding a low molecular weight cationic organic polymer to the suspension prior to adding the cationic organic polymer having one or more aromatic groups.

7. The process of claim 1 further comprising recycling white water and introducing from 0 to 30 tons of fresh water per ton of paper produced.

8. A process for the production of paper from an aqueous suspension containing cellulosic fibers, and optional fillers, which comprises separately adding to the suspension (i) a cationic starch having one or more aromatic groups and having at least one quartemary ammonium group, the cationic starch being added in an amount of at least 0.005% by weight based on dry cellulosic fibers and optional fillers; and (ii) an anionic condensation polymer, the anionic condensation polymer being a formaldehyde-naphtalene sulfonate condensation polymer and being added in an amount of at least 0.001% by weight based on dry cellulosic fibers and optional fillers;

forming and draining the obtained suspension on a wire.

9. The process of claim 8, wherein the cationic starch is cationic potato starch or cationic waxy maize starch.

10. The process of claim 8, wherein the anionic condensation polymer is prepared from one or more aromatic compounds selected from the group consisting of phenyl, phenol, naphthalene, naphthol, and mixtures thereof.

11. The process of claim 8, wherein the suspension has a conductivity of at least 3.5 mS/cm.

12. The process of claim 8 further comprising adding a low molecular weight cationic organic polymer to the suspension prior to adding the cationic starch.

13. The process of claim 8 further comprising recycling white water and introducing from 0 to 30 tons of fresh water per ton of paper produced.

* * * * *